US011543102B2

(12) United States Patent
Calaceto et al.

(10) Patent No.: US 11,543,102 B2
(45) Date of Patent: Jan. 3, 2023

(54) APPARATUSES AND METHODS FOR CHANGING LIGHTING FIXTURE DIMENSIONS

(71) Applicant: RAB Lighting Inc., Northvale, NJ (US)

(72) Inventors: Nicholas Calaceto, Paramus, NJ (US); Jiang Hu, Ningbo (CN)

(73) Assignee: RAB Lighting Inc., New York, NY (US)

( * ) Notice: Subject to any disclaimer, the term of this patent is extended or adjusted under 35 U.S.C. 154(b) by 0 days.

(21) Appl. No.: 17/319,137

(22) Filed: May 13, 2021

(65) Prior Publication Data

US 2021/0332970 A1 Oct. 28, 2021

Related U.S. Application Data

(62) Division of application No. 16/546,875, filed on Aug. 21, 2019, now Pat. No. 11,029,001.

(51) Int. Cl.
*F21V 17/00* (2006.01)
*F21S 8/06* (2006.01)

(52) U.S. Cl.
CPC ..... *F21V 17/007* (2013.01); *F21S 8/063* (2013.01)

(58) Field of Classification Search
CPC ..... F21V 17/007; F21V 23/007; F21V 1/14; F21V 1/143; F21V 1/146; F21V 17/02; F21V 17/08; F21V 23/008; F21V 23/009; F21S 8/063; F21S 9/022; F21W 2131/40
See application file for complete search history.

(56) References Cited

U.S. PATENT DOCUMENTS 3,248,535 A 4/1966 Docimo et al.
3,579,184 A * 5/1971 Forestal ..... B60Q 1/2611 362/234
4,364,104 A 12/1982 Holahan et al.
D447,266 S 8/2001 Verfuerth
6,517,216 B1 * 2/2003 Cercone ..... F21V 21/15 362/371
6,585,396 B1 7/2003 Veruerth
(Continued)

FOREIGN PATENT DOCUMENTS

CN 203363820 12/2013
CN 107166224 9/2017
(Continued)

*Primary Examiner* — Tsion Tumebo
(74) *Attorney, Agent, or Firm* — Innovation Law Office; Dennis S. Schell

(57) ABSTRACT

A lighting fixture configured to expand and collapse, and methods for expanding and collapsing a light fixture are disclosed. Embodiments of the lighting fixture include a lighting fixture with a movable section that collapses into at least one cavity in a base housing for storage and shipment, and extends from the cavity for operation. In the collapsed configuration the lighting fixture fits into a smaller container than when the lighting fixture is in the expanded configuration. In some embodiments a locking member locks the movable section into its extended position and can be retracted by a user by manually disengaging the locking member. Accessories and extenders that can be attached to the lighting fixture can be stored in the one or more cavities into which the movable section is stowed in the collapsed configuration.

20 Claims, 15 Drawing Sheets

(56) References Cited

U.S. PATENT DOCUMENTS

| | | | | |
|---|---|---|---|---|
| 7,329,026 | B1 * | 2/2008 | Hayman | F21V 11/12 362/346 |
| 7,401,942 | B1 | 7/2008 | Verfuerth et al. | |
| 7,431,482 | B1 * | 10/2008 | Morgan | F21S 2/005 362/249.07 |
| 7,784,966 | B2 | 8/2010 | Verfuerth et al. | |
| 8,376,583 | B2 | 2/2013 | Wang et al. | |
| 8,523,381 | B1 | 9/2013 | Clements et al. | |
| D706,481 | S | 6/2014 | Holland et al. | |
| 8,858,018 | B2 | 10/2014 | Verfuerth et al. | |
| 9,016,892 | B1 | 4/2015 | Scribante et al. | |
| 9,518,722 | B1 | 12/2016 | Lehman et al. | |
| 10,234,110 | B2 * | 3/2019 | Farzan | F21V 21/22 |
| 2008/0186719 | A1 | 8/2008 | Engel | |
| 2009/0091930 | A1 | 4/2009 | Probasco | |
| 2009/0244912 | A1 | 10/2009 | Lydecker et al. | |
| 2010/0284185 | A1 | 11/2010 | Ngai | |
| 2012/0002428 | A1 * | 1/2012 | Tomasi | F21V 17/007 362/382 |
| 2012/0155073 | A1 | 6/2012 | McCanless et al. | |
| 2013/0141904 | A1 | 6/2013 | Verfuerth et al. | |
| 2013/0286637 | A1 | 10/2013 | Lay et al. | |
| 2014/0252249 | A1 * | 9/2014 | Doros | F21V 5/043 362/311.1 |
| 2014/0301071 | A1 | 10/2014 | Jorgensen et al. | |
| 2014/0313744 | A1 * | 10/2014 | Collias | F21V 5/045 362/311.02 |
| 2015/0036387 | A1 | 2/2015 | Myers | |
| 2016/0146407 | A1 * | 5/2016 | Pelletier | G02B 7/005 345/697 |
| 2016/0327252 | A1 | 11/2016 | Ray et al. | |
| 2017/0254486 | A1 | 9/2017 | Verfuerth et al. | |
| 2017/0330868 | A1 | 11/2017 | Pu et al. | |
| 2019/0011097 | A1 | 1/2019 | Lee et al. | |
| 2019/0049100 | A1 * | 2/2019 | Seligman | F21V 21/025 |
| 2019/0063724 | A1 * | 2/2019 | Vice, Jr. | F21V 17/12 |
| 2019/0203909 | A1 * | 7/2019 | Heemstra | G02B 26/08 |
| 2019/0242123 | A1 * | 8/2019 | Kouijzer | F21V 7/0041 |
| 2019/0264882 | A1 | 8/2019 | Gomez Martinez et al. | |

FOREIGN PATENT DOCUMENTS

| | | |
|---|---|---|
| CN | 107435844 | 12/2017 |
| CN | 107781749 | 3/2018 |

* cited by examiner

APPARATUSES AND METHODS FOR CHANGING LIGHTING FIXTURE DIMENSIONS

PRIORITY

This application is a divisional of U.S. patent application Ser. No. 16/546,875, entitled "Apparatuses and Methods for Changing Lighting Fixture Dimensions," filed Aug. 21, 2019, the disclosure of which is incorporated by reference herein.

FIELD

Embodiments of this disclosure relate generally to lighting fixtures (also known as luminaires) and lighting fixtures with changeable configurations, including lighting fixtures with configurations that may be changed for storage, shipping or use.

BACKGROUND

Once lighting fixtures are manufactured, they are typically placed in containers such as cardboard boxes for storage or shipping. At least one problem realized by the inventors of the current disclosure is that the lighting fixtures can occupy a lot of space, requiring a lot of space for storing the lighting fixtures or increasing the cost of shipping the lighting fixtures. The inventors noticed this was especially true for lighting fixtures that are relatively large when installed, such as troffer or high bay lights that are frequently used in business environments. As such, the inventors realized that problems exist with the current lighting fixtures and that improvements in the ability to change the size of the lighting fixture, such as for storage or shipping, are needed. Certain features of the present disclosure address these and other needs and provide other important advantages.

SUMMARY

Embodiments of the present disclosure provide improved apparatuses and methods for changing the dimensions of a lighting fixture, including a lighting fixture that can change its overall size and dimensions. Various aspects of different embodiments of the present disclosure are expressed in the following three (3) paragraphs as follows:

At least one embodiment of the present disclosure includes an expandable high-bay lighting fixture mountable to a ceiling, comprising: an array of lighting elements configured to emit light; a driver electrically coupled to the array of lighting elements and configured to receive power from a building's power source and supply power to the array of lighting elements to illuminate the array of lighting elements; a driver housing including a mounting surface and housing the driver, the mounting surface configured to mount to a ceiling of the building and permit an electrical connection between the driver and the building's power source; and a lower housing connected to the driver housing, the lower housing including a top surface and a cavity configured to receive the driver housing, wherein the driver housing is selectively positionable in relation to the lower housing between a retracted position defined by the driver housing being received within the cavity and the driver housing's mounting surface being flush with or below the top surface of the lower housing, and an extended position defined by the mounting surface of the driver housing being extended above the top surface of the lower housing.

At least one other embodiment of the present disclosure includes an expandable lighting fixture for a room, comprising: a lighting element; a driver electrically connected to the lighting element; an upper housing connected to the lighting element and the driver, the upper housing configured to attach to a building; a lens for protecting the lighting element; and a lower housing connected to the lens, the lower housing being movably connected to the upper housing, wherein the upper housing and the lower housing are movably connected to one another defining a collapsed configuration and an expanded configuration, wherein the collapsed configuration is defined by one of the upper housing and the lower housing being received within a cavity of the other of the upper housing and the lower housing and the lighting element and the lens being positioned a distance from one another, and wherein the expanded configuration is defined by the housing that is received within the cavity in the collapsed configuration extending out of the cavity and the lighting element and the lens being positioned a greater distance from one another than in the collapsed configuration.

At least one other further embodiment of the present disclosure includes a lighting fixture kit, comprising: a light emitter; a driver electrically connected to the light emitter; a driver housing retaining the driver; a second housing connected to the driver housing and including an outer surface, the outer surface defining one or more cavities, wherein the one or more cavities receive the driver housing; and one or more lighting accessory connectors dimensioned to fit within the one or more cavities with the one or more lighting accessory connectors and dimensioned to be flush with or inside the outer surface of the second housing when positioned within the one or more cavities, wherein the driver housing is extendable from the one or more cavities to a position where at least one portion of the driver housing extends beyond the outer surface of the second housing, the one or more lighting accessory connectors are removable from the one or more cavities and mountable to the driver housing or the second housing enabling connection of one or more lighting accessories that affect the operation of the light emitter, and the driver housing and the second housing are mountable to a ceiling to enable an electrical connection between the driver and a ceiling power when the driver housing is extended from the one or more cavities of the second housing.

Yet other embodiments include the features described in any of the previous three (3) paragraphs as combined with: (i) one or more of the previous three (3) paragraphs, (ii) one or more of the remaining nineteen (19) paragraphs in this Summary section, or (iii) one or more of the previous three (3) paragraphs and one or more of the remaining nineteen (19) paragraphs in this Summary section.

A locking mechanism configured to automatically lock the driver housing in the extended position when the driver reaches the extended position, or to automatically lock the driver housing in relation to the second housing when the driver housing and the second housing are in the expanded configuration.

A locking mechanism that includes an actuator configured to allow a user to disengage the locking mechanism when the driver housing and the second housing are in the expanded configuration allowing the driver housing and the second housing to collapse to the collapsed configuration.

A sliding mechanism allowing the driver housing to slide between the retracted position and the extended position.

A reflector connected to array of lighting elements and to the driver housing.

A lens connected to the lower housing or the second housing.

A light emitter extending in relation to the lens as the driver housing extends in relation to the second housing.

At least one lighting accessory connector positionable in the cavity with the driver housing and dimensioned to be contained within the cavity, the lighting accessory connector being removable from the cavity and configured to connect to the driver housing or the lower housing and provide an attachment location for a lighting accessory.

An auxiliary battery housing connected to the driver housing, the retracted position being further defined by the auxiliary battery housing being received within the cavity and the auxiliary battery housing being flush with or below the top surface of the lower housing.

The lighting fixture defining a collapsed height with the driver housing in the retracted position and an expanded height with the driver housing in the extended position, wherein the collapsed height is approximately one-half (½) the expanded height.

A lower housing that is rectangular and defines a length, the driver housing forming a central raised portion spanning the length of the lower housing.

A locking mechanism including an actuator configured to disengage the locking mechanism allowing the driver housing to move from the extended position toward the retracted position when the actuator is actuated by a user.

A reflector and lens that move away from one another as the driver housing moves from the retracted position to the extended position.

A slide mechanism allowing the upper housing to be slidably extended upward from the cavity of the lower housing.

An automatic locking mechanism allowing the upper housing and the lower housing to be automatically locked in the expanded configuration.

An actuator configured to disengage the automatic locking mechanism allowing the upper housing and the lower housing to transition from the expanded configuration to the collapsed configuration.

A lens connected to a lower housing, a lighting element is attached to an upper housing, the lighting element moving the same distance as the upper housing when the upper housing moves in relation to the lower housing.

A cavity defined by the lower housing, the upper housing being received within the cavity, and the upper housing being constrained within the outer dimensions of the lower housing when the upper housing and the lower housing are in the collapsed configuration.

A driver housing that is flush with or within the outer surface of the second housing when the driver housing is received within the one or more cavities.

A driver housing and a second housing defining a collapsed configuration defined by the at least one portion of the driver housing being contained within one or more cavities in the second housing, and an expanded configuration defined by the at least a portion of the driver housing extending beyond the outer surface of the second housing a predetermined distance, wherein the height of the combined driver housing and second housing in the collapsed configuration is approximately one-half (½) the height of the combined driver housing and second housing in the expanded configuration.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
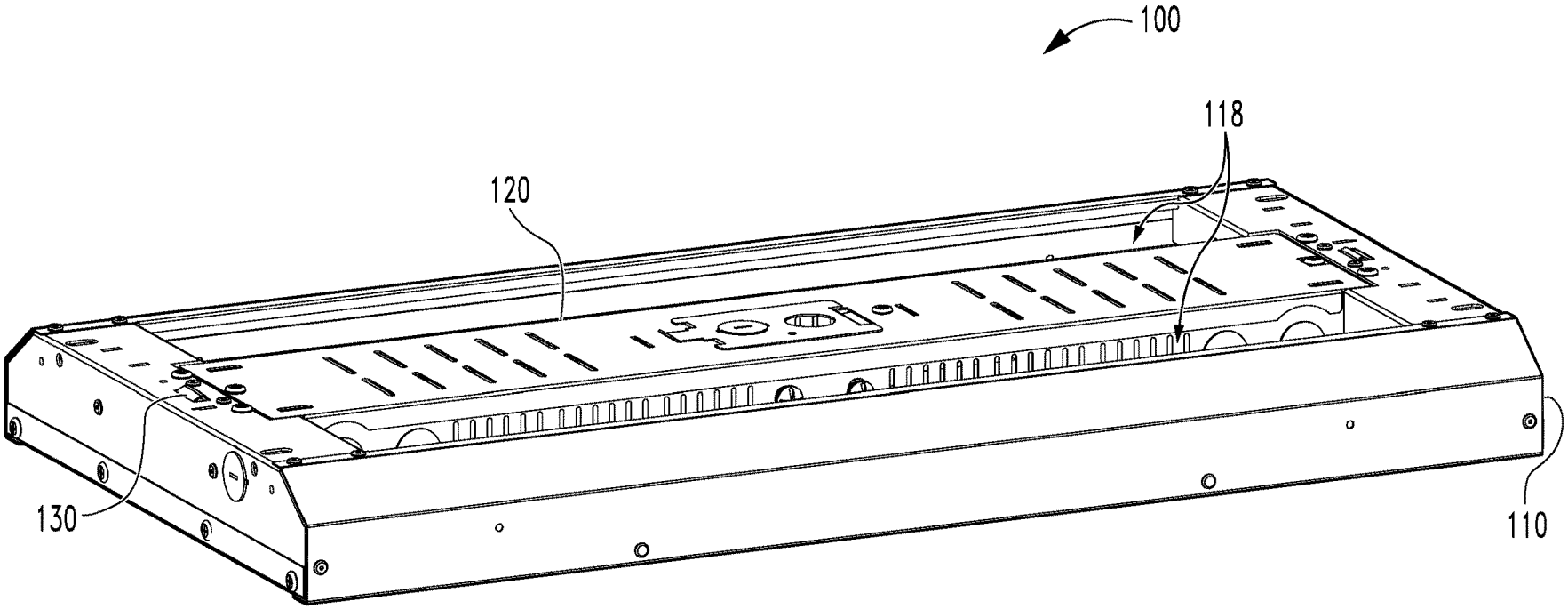
FIG. 1 is a perspective view of a lighting fixture in a collapsed configuration according to one embodiment of the present disclosure.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present disclosure include a lighting fixture that contracts for storage or shipping, reducing the size of the lighting fixture and the storage or shipping container, and expands for installation and operation. A portion of the lighting fixture (for example, an upper housing such as driver housing) that is used to mount the lighting fixture to a building (for example, a ceiling in a room) can be manually pulled from a retracted position within the lighting fixture's housing to an extended position where the portion sticks out of one side (for example, the top) of the lighting fixture. The capability to expand and contract is built into the fixture with the extendable and/or retractable portion moving (for example, sliding) from one position to the other. Once in the extended position, the fixture can lock itself in the expanded configuration to make installation easier. Nevertheless, the lighting fixture can be easily returned to the collapsed configuration by manually releasing the locking mechanism and returning the extended portion to its retracted position within the light fixture's housing. One embodiment incorporates this type of expandable-contractable functionality into a high-bay lighting fixture (which is generally thought of as a lighting fixture with an inverted trough-like feature serving as a support and as a reflector for a light source) or a high bay lighting fixture (which is generally thought of as a lighting fixture than hangs below an unusually high ceiling), and is commonly used in commercial buildings and warehouses.

Depicted in FIGS. 1-9 is an expandable-collapsible lighting fixture 100 according to one embodiment of the present disclosure. Fixture 100 includes a base 110 an extendable and/or retractable member (for example, movable member 120), and an optional locking member 130.

Figure 2:
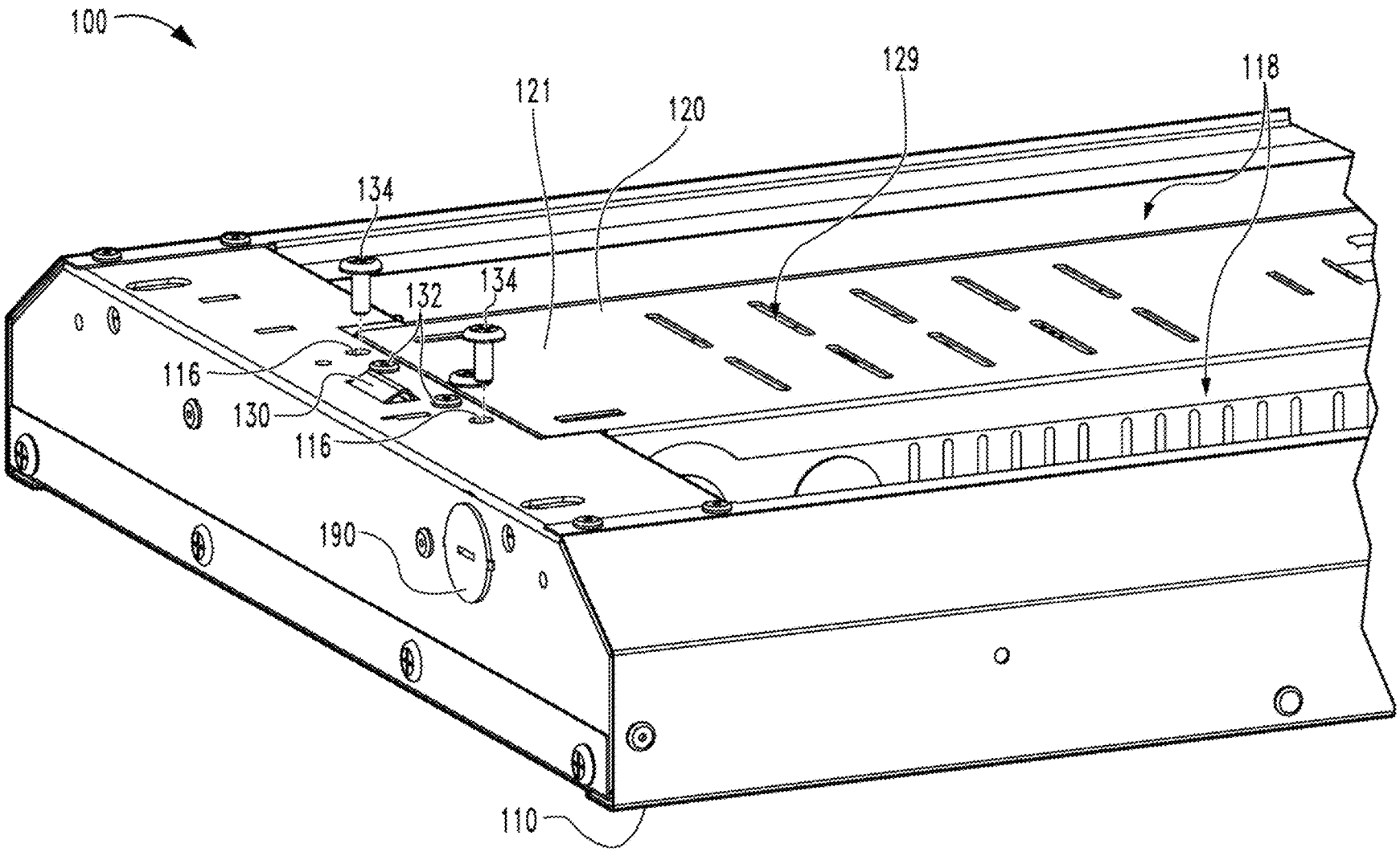
FIG. 2 is a partial view of the lighting fixture depicted in the FIG. 1.
Figure 3:
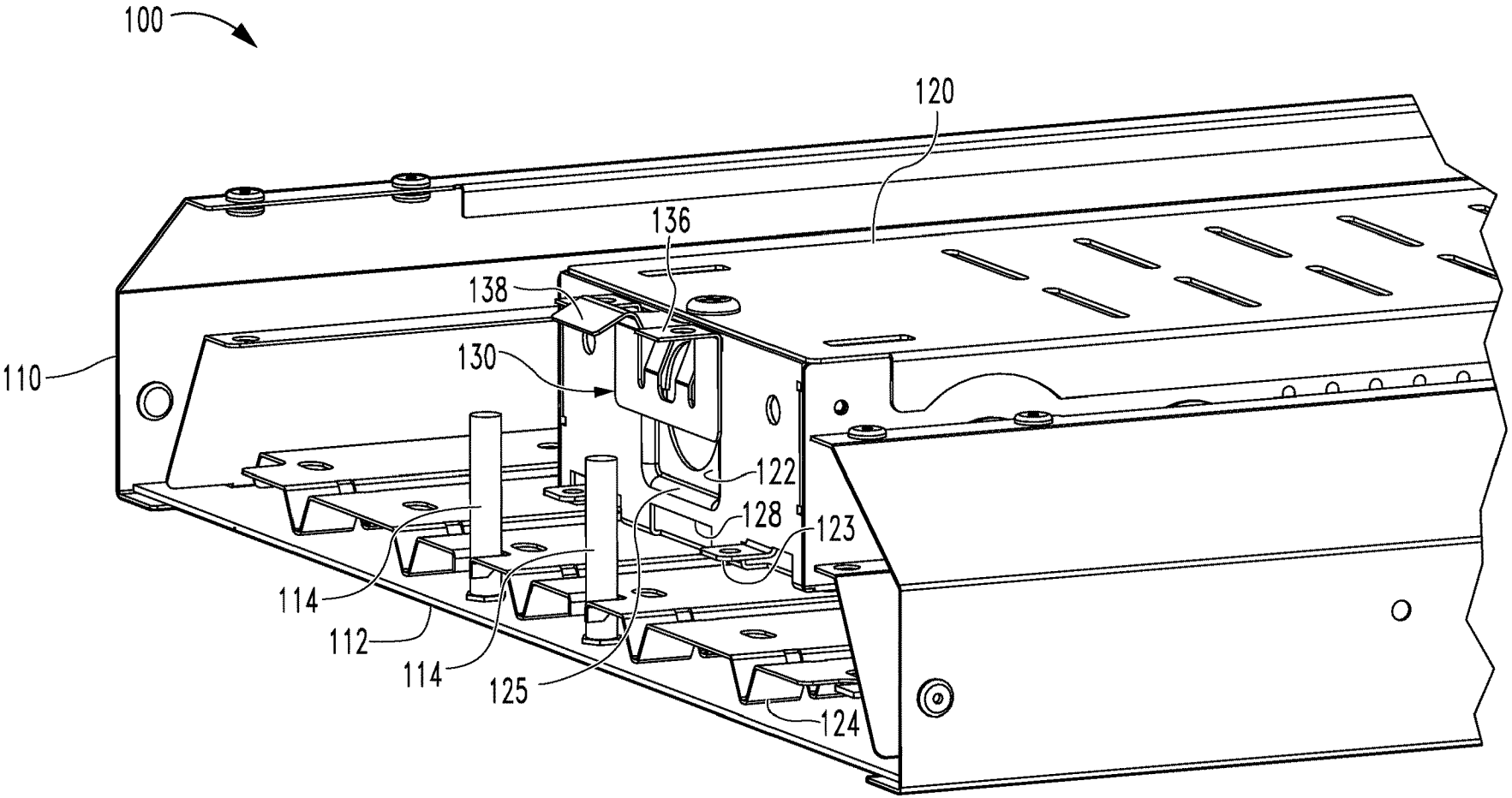
FIG. 3 is a partial view of the lighting fixture depicted in FIG. 1 with panels removed to expose select interior portions of the lighting fixture.
Figure 4:
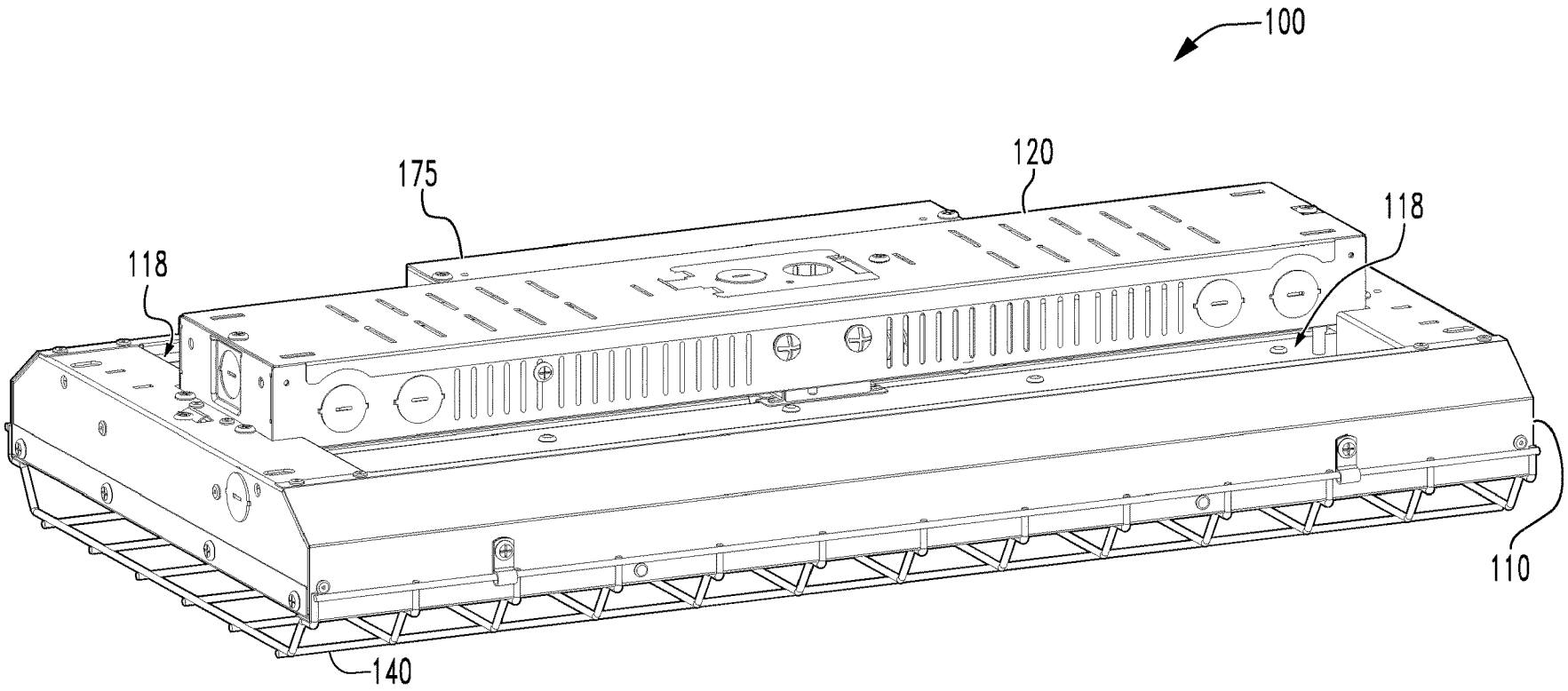
FIG. 4 is a perspective view of the lighting fixture depicted in FIG. 1 in the expanded configuration and with a protective cover installed.
Figure 5:
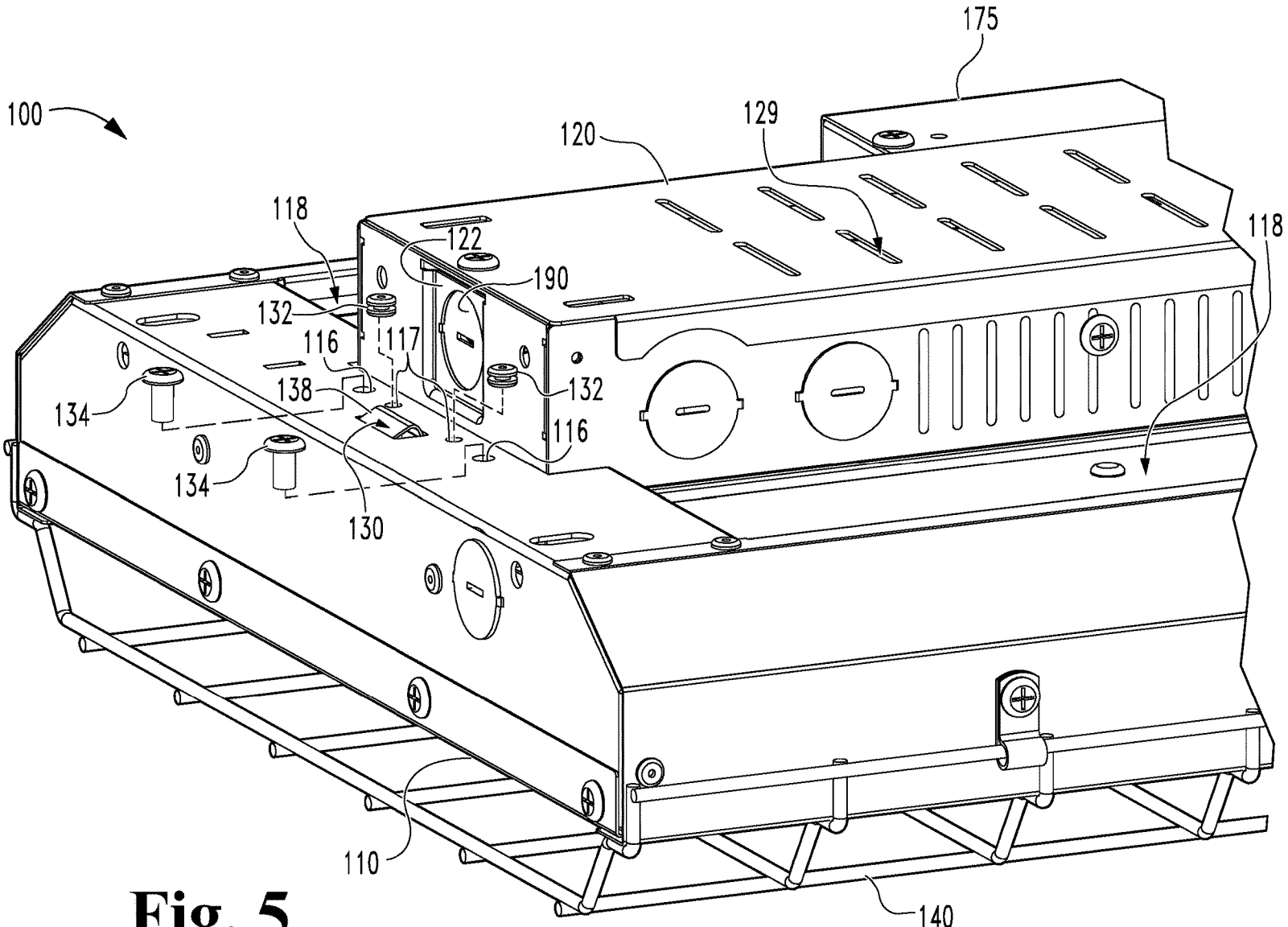
FIG. 5 is a partial view of the lighting fixture depicted in the FIG. 4.
Figure 6:
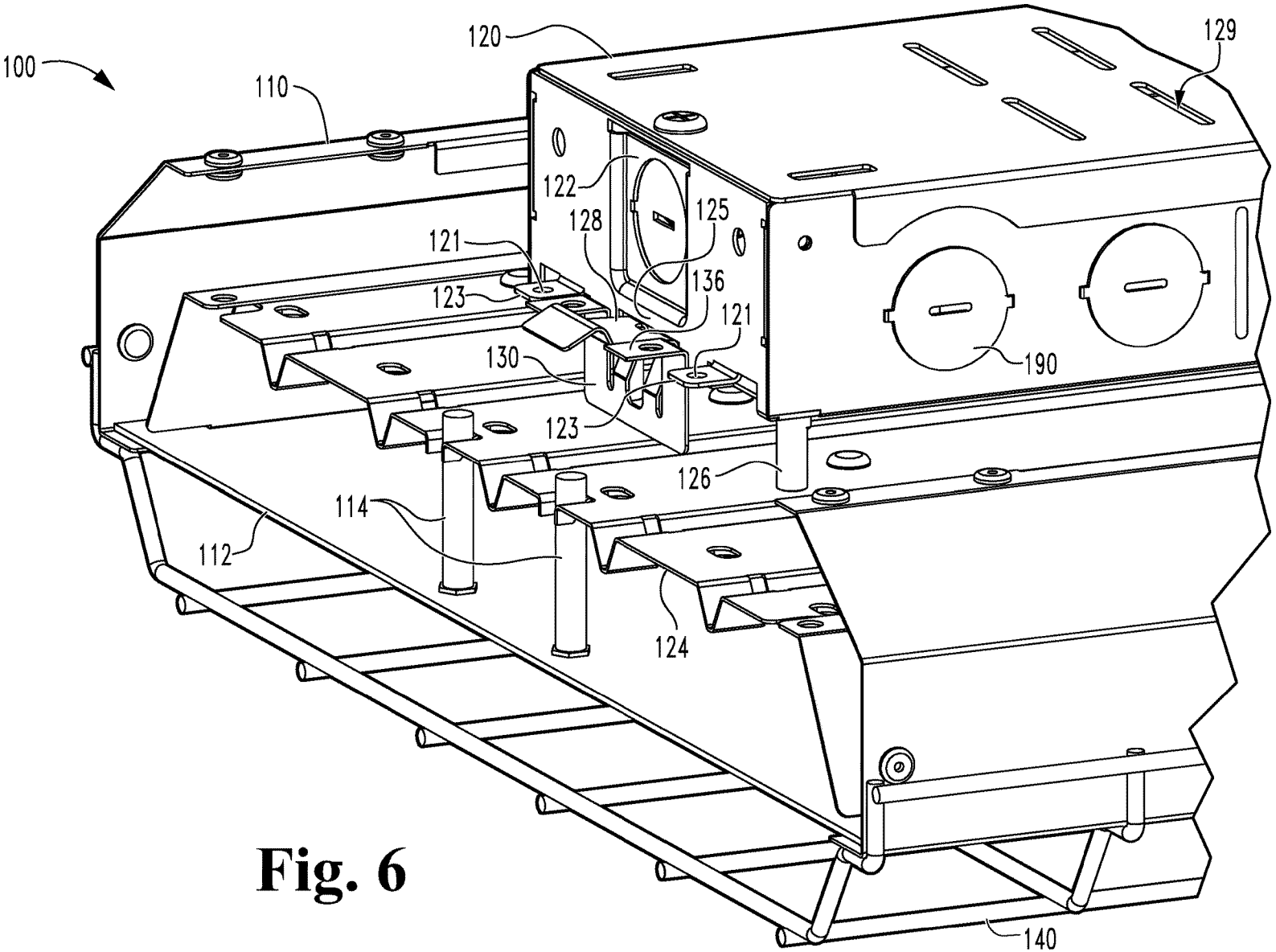
FIG. 6 is a partial view of the lighting fixture depicted in FIG. 4 with panels removed to expose select interior portions of the lighting fixture.
Figure 7:
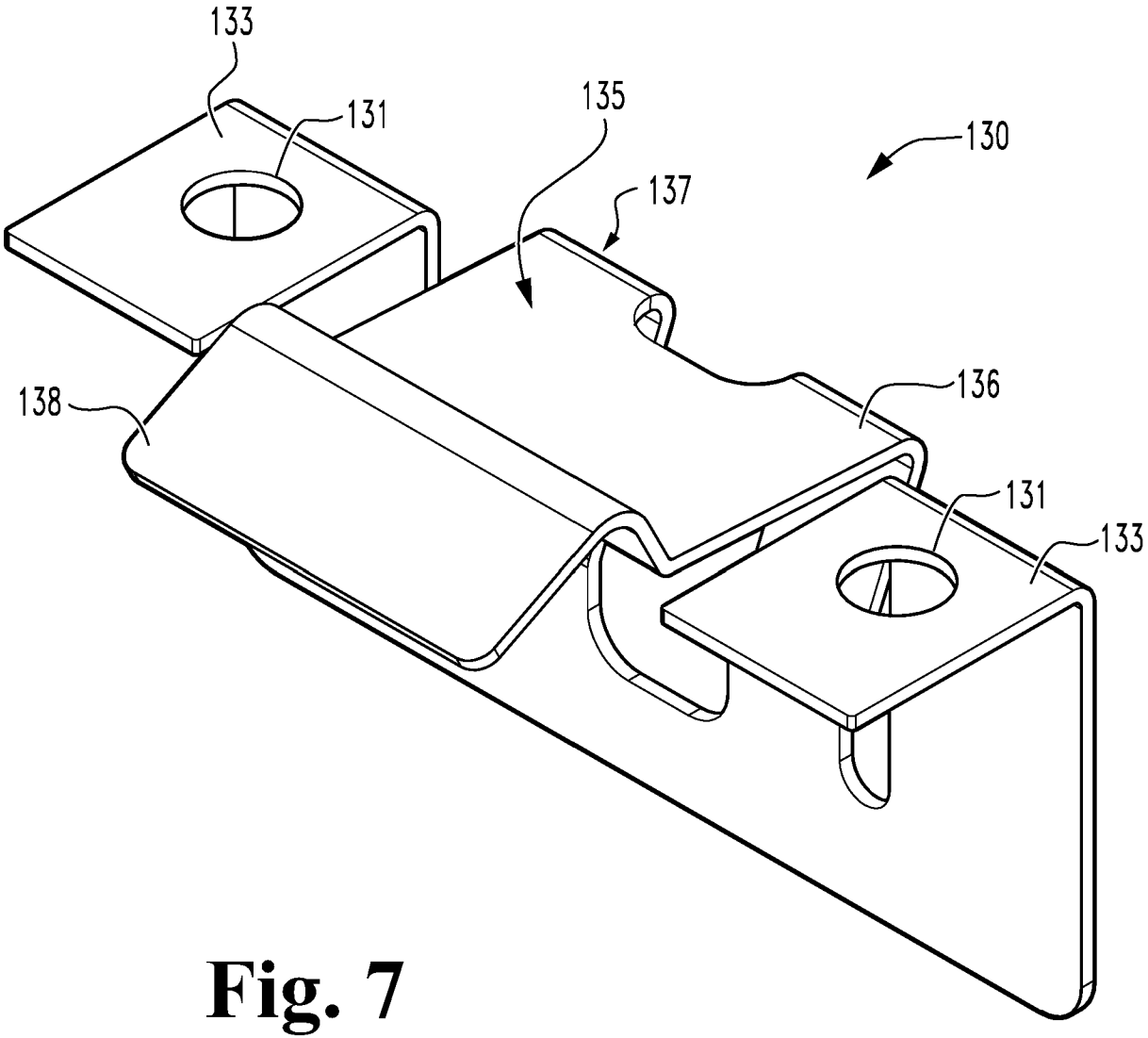
FIG. 7 is a perspective view of a locking member according to one embodiment of the present disclosure.
Figure 8:
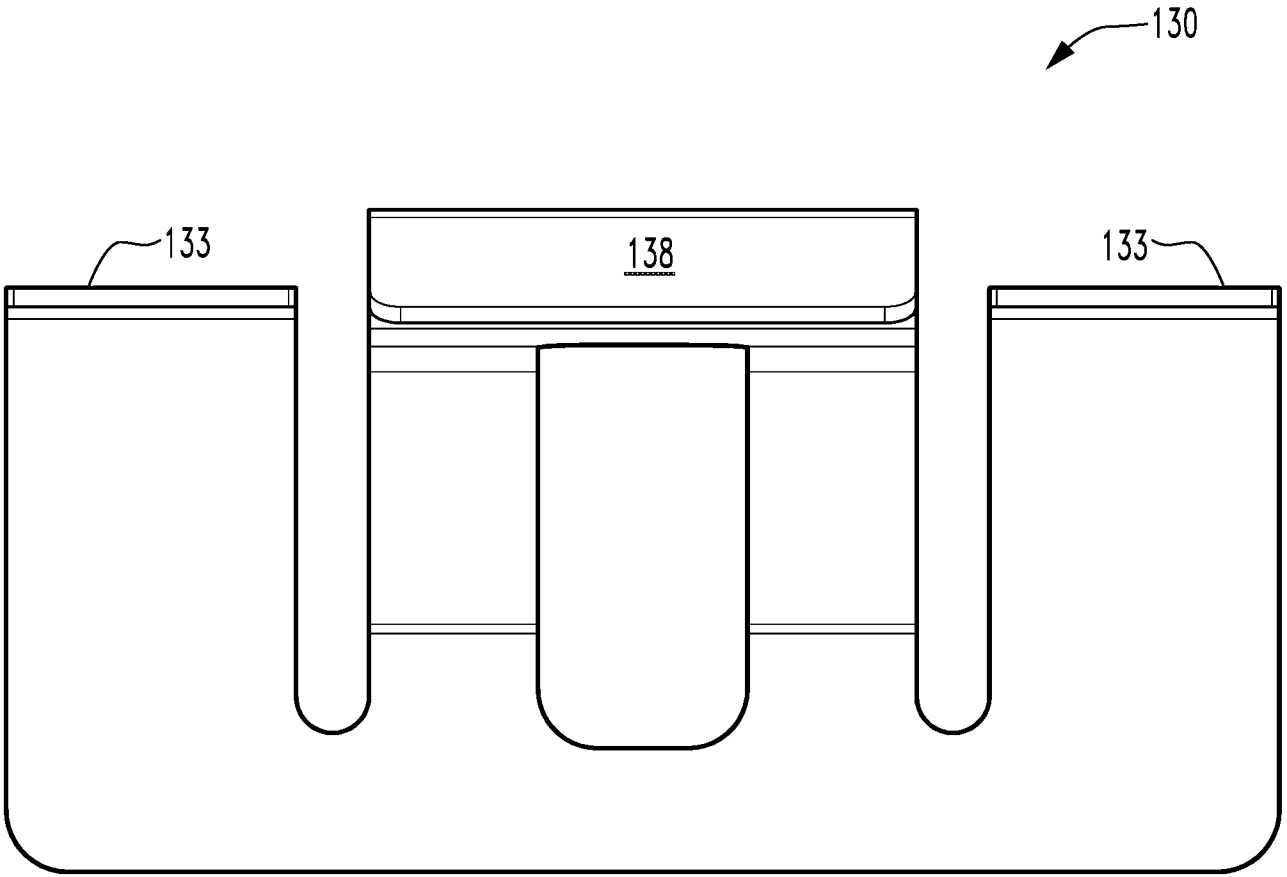
FIG. 8 is front elevational view of the locking member depicted in FIG. 7.
Figure 9:
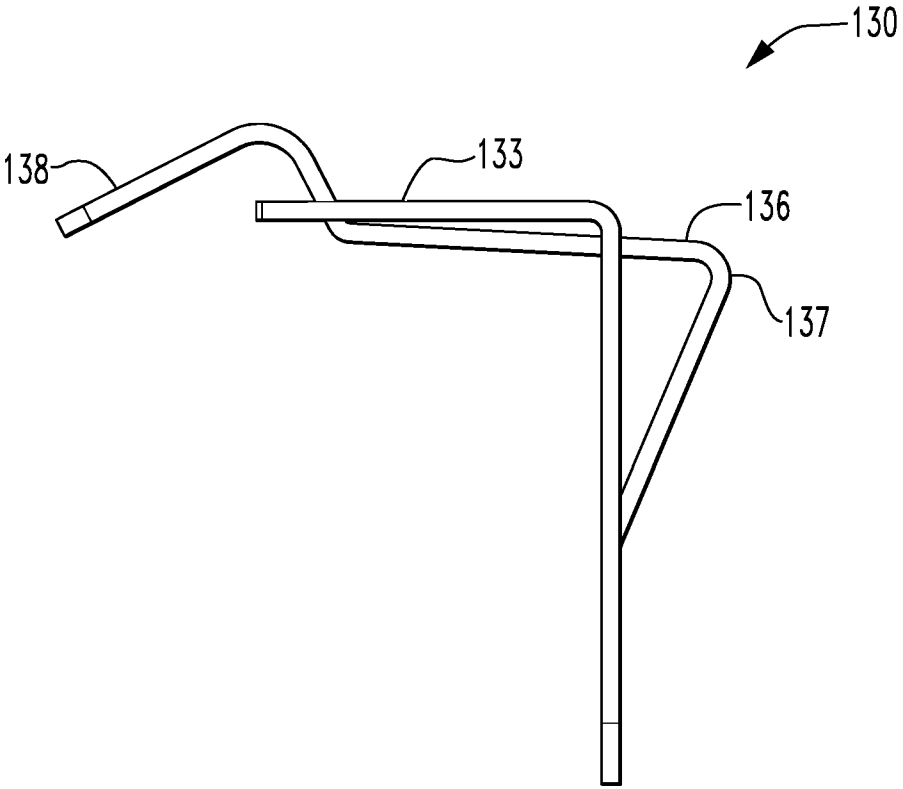
FIG. 9 is a side elevational view of the locking member depicted in FIG. 7.

The movable member 120 is attached to base member 110 and includes a retracted position in which the movable member 120 is received within one or more cavities (for example, cavity 118) as depicted in FIGS. 1-3 and an extended position where the movable member 120 extends from the one or more cavities (for example, cavity 118) as depicted in FIGS. 4-6. When the movable member 120 is in the extended position, the movable member 120 increases the outer dimensions (for example, size) of the lighting fixture 100 from what the outer dimension of the lighting fixture 100 is when movable member 120 is in the retracted position. The lighting fixture 100 is operated while in its expanded configuration and shipped or stored when in its collapsed configuration.

In some embodiments, when the movable member 120 is in the retracted position and received within cavity 118, the movable member 120 is flush with the outer dimensions of the base 110. In the embodiment illustrated in FIGS. 1-3, the movable member 120 is flush with the upper exterior surface of base 110 when movable member 120 is in the retracted position, indicating that a flat piece of shipping material (for example, cardboard) can be placed over the top of and in contact with the retracted movable member 120 and the base 110 without damaging the shipping material (for example, without creasing the cardboard). As such, the movable member 120 may extend somewhat outside the outer dimensions of base 110 when it is flush and in the retracted position, but the amount the movable member 120 extends past the outer dimensions of base 110 is not enough to cause damage to the shipping material. In other embodiments, when the movable member 120 is in the retracted position and received within cavity 118, the movable member 120 is constrained within (does not extend beyond) the outer dimensions of the base 110. As an example, when the lighting fixture 100 is oriented with the movable member 120 capable of extending upward, the movable member 120 is positioned below the top surface of the base 110 and is surrounded on four (4) sides by the base 110 when the movable member 120 is in the retracted position and received within cavity 118.

In the illustrated embodiment, the movable member 120 is centrally located (which enhances the ability of the lighting fixture to remain it vertical/horizontal alignment when installed), spans approximately the entire length of the lighting fixture 100 (at least 90% the length of lighting fixture 100) and reduces the overall height of lighting fixture 100 to approximately one-half (½) of its height when the movable member 120 is extended. The result is that moving the movable member 120 to its retracted position prior to shipping or storing results in a sixty percent (60%) reduction in total shipping volume, reducing shipping costs and increasing the number of packaged lighting fixtures 100 that may be stored in a given location. It should be appreciated that in other embodiments the movable member may extend substantially less than the entire length of the lighting fixture 100 or may reduce the total height of lighting fixture to more than one-half (½), such as to two-thirds (⅔), of its height when the movable member 120 is extended.

The locking member 130 retains the movable member 120 in the extended position, and in some embodiments the locking member 130 retains the movable member 120 in the retracted position. In the illustrated embodiment, locking member 130 is a spring clip that is attached to base 110 with fasteners 132. However, in other embodiments the locking member 130 is attached to moving member 120 with fasteners 132. Fasteners 132 hold the fastening portions 133 of locking member 130 (see FIGS. 7-9) to base 110. In the example embodiment depicted in FIGS. 1-6, fasteners 132 are rivets that protrude through apertures 117 in base 110 and apertures 131 in locking member 130, holding locking member 130 and base 110 securely together. Alternate embodiments utilize different types of fasteners such as bolts (typically in conjunction with nuts), adhesives, welding, screws and other types of fastening members capable of holding the two members together.

Locking member 130 interacts with the member (either movable member 120 or base 110) to which locking member 130 is not attached to hold movable member 120 in the extended position. In the example embodiment, locking member 130 interacts with movable member 120 to hold movable member 120 in the extended position relative to base 110. In the illustrated embodiment, locking surface 136 of locking member 130 interacts with retaining surface 128 of movable member 120 to hold movable member 120 in the extended position. In the illustrated embodiment, retaining surface 128 is a surface defining an aperture of movable member 120. When movable member 120 reaches its extended position, locking member 130 will snap into position, and can provide an audible feedback so the user knows when the movable member 120 is fully extended.

With the movable member 120 in the extended position, an optional auxiliary locking member 123 can be used to securely hold the movable member 120 in the extended position with respect to the base 110. Extending a fastener 134 through the aperture 116 in the base 110 and through the aperture 121 in the auxiliary locking member 123 of moving member 120 will enhance the secure retention of the movable member 120 in the extended position with respect to the base 110.

The overall mechanism retaining movable member 120 in the extended position relative to base 110 may be thought of as having portions attached to (or incorporated with) both base 110 and movable member 120. However, for ease of understanding by the reader, locking member 130 is described as a separate member that is associated with base 110 (or movable member 120) and interacting with a part of movable member 120 (or base 110). In alternate embodiments, locking member 130 is a part of the structure defining base 110 (for example, locking member 130 is part of the material (for example, metal) that forms base 110), is part of the structure defining movable member 120, or is part of the structure defining both base 110 and movable member 120 instead of being a separate member (for example, locking member 130) that is connected to base 110 or movable member 120.

Movable member 120 may also be connected to a lamp mounting member 124, such as by one or more connectors 126. Connected to lamp mounting member 124 are one or more light sources, which may also be referred to as lamps (for example, light emitting diodes (LEDs)) that generate light for the fixture 100. Lamp mounting member 124 may include a reflective surface to assist in directing the light from the light sources in the appropriate direction (or directions). Lamp mounting member 124 optionally includes ridges, which can assist in stiffening lamp mounting member 124 and can provide additional reflected surfaces for directing the light emanating from the light sources. In FIGS. 3 and 6 the ridges are depicted as V-shaped ridges/troughs, although other embodiments utilize other geometric shapes.

In the illustrated embodiment where movable member 120 is connected to lamp mounting member 124, movement of movable member 120 relative to base 110 results in movement of lamp mounting member 124 relative to base 110. Optional guides 114 may be included in some embodiments to provide guidance for lamp mounting member 124 as lamp mounting member 124 moves between its extended position (which is reached when movable member 120 reaches its extended position as shown in FIG. 6) and its stowed position (which is reached when movable member 120 reaches its stowed position as shown in FIG. 3).

Movable member 120 can also include electronic circuitry 129 for the lighting fixture 100. For example, in embodiments in which the light sources are LEDs, the electronic circuitry 129 includes one or more drivers that convert alternating electrical current (AC current) to the appropriate direct electrical current (DC current) required to illuminate the LEDs. In these embodiments, movable member 120 also serves as a driver housing. In other embodiments the electronic circuitry can include ballasts, transformers, or other circuitry associated powering light emitting devices (lamps).

Locking member 130 can optionally include an actuator 138 allowing a user to manually actuate locking member 130. When actuator 138 is depressed in the illustrated embodiment, locking surface 136 of locking member 130 is retracted away from (in other words, disengages from) retaining surface 128 of movable member 120 allowing movable member 120 to move from its extended position to its retracted position. In embodiments where movable member 120 is locked in its retracted position, actuation of actuator 138 can allow movable member 120 to move to its extended position.

When using light sources (lamps) that emit a large amount of light from a small area, such when using chip-on-board ("COB") LED arrays, it can be desirable to position a lens (for example, lens 112) between the light source and the object to be illuminated, such as to disperse or focus the light in a more desirable or pleasing manner. Positioning such a lens away from the light source(s), such as by positioning the lens a certain distance from the light source(s), can also be advantageous. For example, in embodiments utilizing one or more high-intensity light sources, a lens intended to diffuse the light can be less effective when positioned immediately adjacent to the high-intensity light source(s) and a designer of a lighting fixture may want to modify the way in which the light appears (such as to create more appealing light) by positioning the lens away from the light source and allowing the light to travel farther from its source before reaching the lens.

In the example embodiment depicted in FIGS. 1-6, lamp mount 124 is positioned in close proximity to lens 112 when movable member 120 is in the retracted position (see FIG.

3). However, when movable member 120 is moved to its extended position, lamp mount 124 is moved (due to lamp mount 124's connection to movable member 120 via connectors 126) farther from lens 112, in other words, to a position where the space between lamp mount 124 and lens 112 is increased. Since the user need only move the movable member 120 in order to move both the movable member 120 and the lamp mount 124, user set-up of the fixture 100 is greatly simplified. In addition to potentially assisting in creating a more pleasant light distribution pattern, moving the lamp mount 124 away from the lens 112 increases the volume of air immediately adjacent the light emitters attached to lamp mount 124, thereby enhancing the ability of the fixture 100 to cool the light emitters.

Depicted in FIGS. 10-17 are accessory connectors and electronic lighting accessories that can be included in the same relatively small packaging required to ship lighting fixture 100 by itself and attached to the lighting fixture 100 when the lighting fixture 100 is removed from its packaging, such as upon reaching its final destination. The accessories are generally not required for the proper operation of lighting fixture 100, although they may be desirable by end users to enhance the operability of fixture 100.

In some embodiments, such as the embodiment depicted in FIGS. 1-6, there is no need to use separate packaging or increase the size of the packaging to ship the accessories with the lighting fixture 100. The accessories can be placed within the same container (for example, cardboard box) that is used for storing or shipping the lighting fixture 100 without requiring an increase in the size of the container. Described somewhat differently, instead of having to increase the size of the packaging to include accessories that increase the overall dimensions of lighting fixture 100 when installed, the accessories can be removed prior to packaging, requiring smaller packaging and decreasing the amount of packaging material and postage required, thereby decreasing the overall cost required to ship and/or store lighting fixture 100. For example, the lighting fixture 100 includes two cavities 118 into which accessories can be placed for storage and/or shipping. The two cavities 118 extend almost the entire length of the lighting fixture 100 (at least 90% the length of lighting fixture 100) on either side of the movable member 120.

Movable member 120 optionally includes a track 122 to accommodate locking member 130. Track 122 is configured to receive the locking surface 136 and abutting surface 137 of the locking member 130 allowing the movable portion 120 to extend or retract without the abutting surface 137 contacting the movable member 120. In the depicted embodiment the track 122 is a recessed portion of the movable member 120, although in some embodiments the track 122 is not recessed. In alternate embodiments the track 122 is a portion of the movable member 120 (or a portion of the base 110 when the locking member 130 is connected to the movable member 120) with a surface adapted for sliding engagement with abutting surface 137 so that abutting surface 137 will slide over the track 122 as the movable member 120 is extended or retracted.

Figure 11:
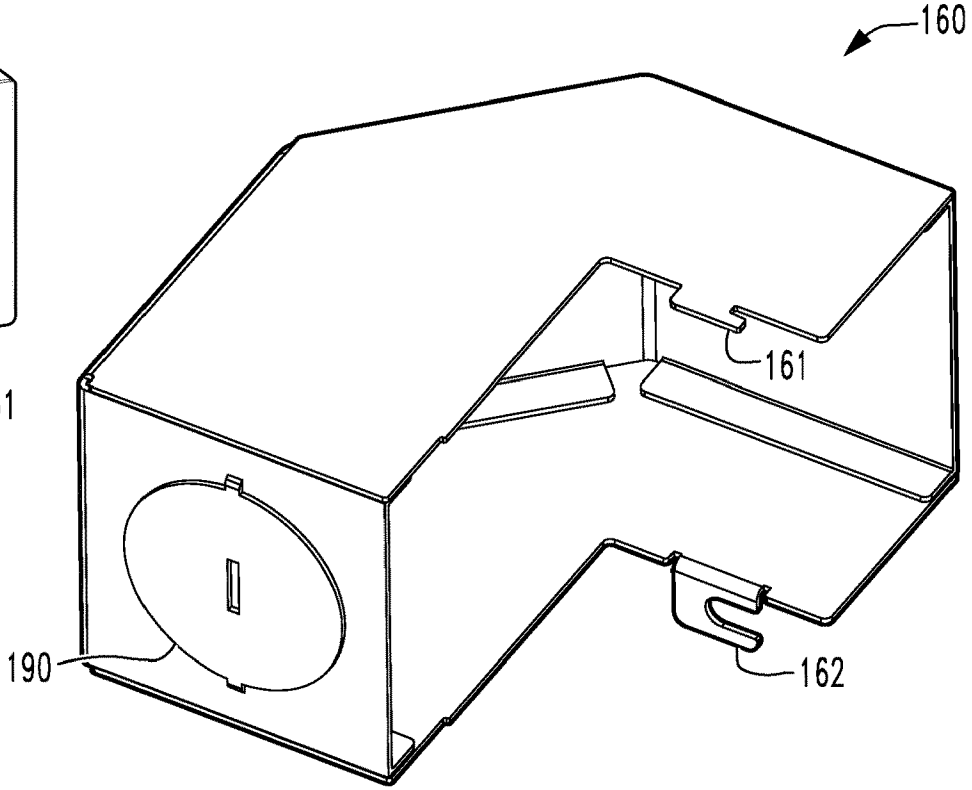
FIG. 11 is a lower perspective view of the accessory extension arm depicted in FIG. 10.
Figure 10:
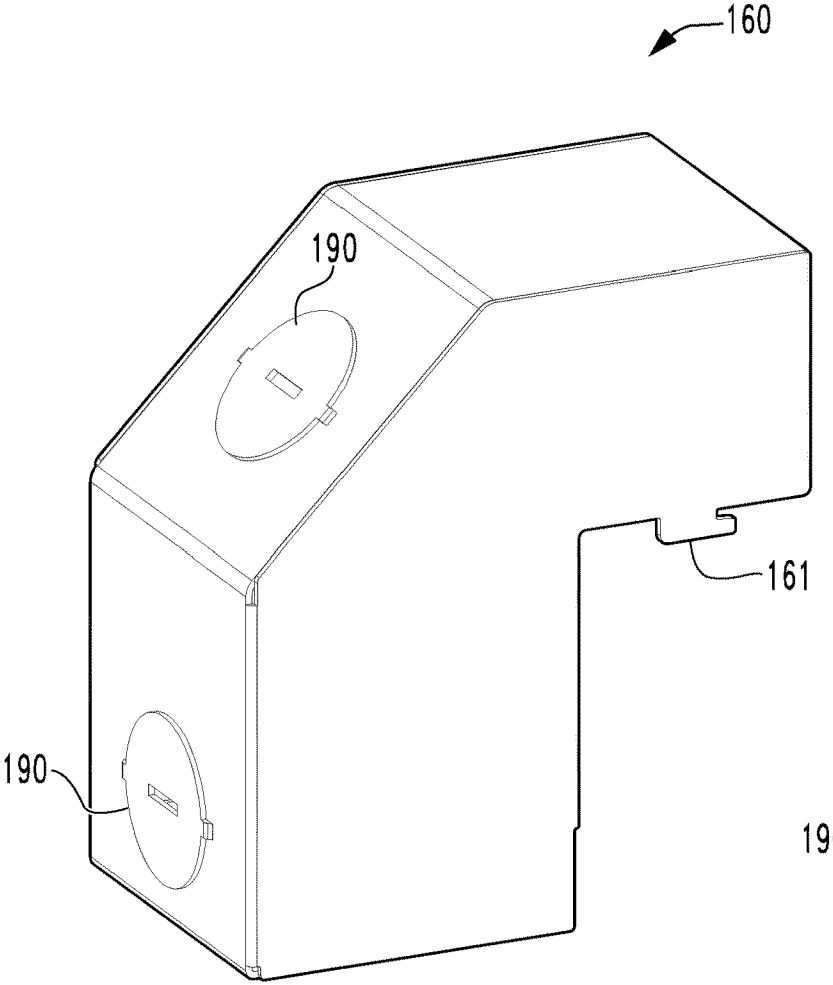
FIG. 10 is an upper perspective view of an accessory extension arm according to a first embodiment of the present disclosure.
Figure 17:
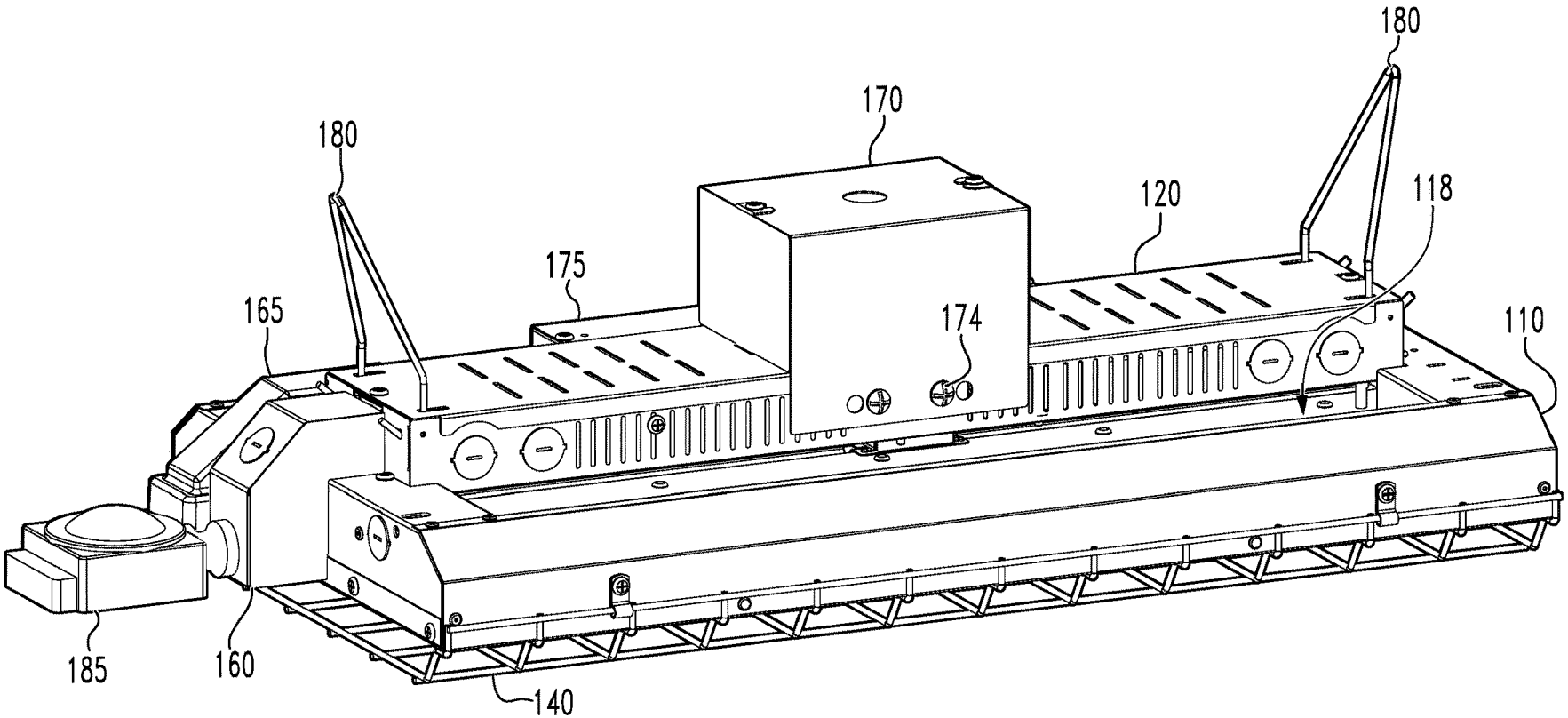
FIG. 17 is a perspective view of a lighting fixture with multiple connected lighting accessory connectors and electronic lighting accessories according to one embodiment of the present disclosure.

An accessory connector, for example, extension arm accessory 160, according to one embodiment of the present invention is depicted in FIGS. 10, 11 and 17. Extension arm 160 includes connectors 161 and 162 for attaching the extension arm 160 to the lighting fixture 100. For ease of installation the connector 161 is configured as a slotted tab that fits into a slot in the base 110 and slides to engage the connector 161 with the base 110. The connector 162 is configured to align with an aperture, such as screw or bolt hole, in base 110 so that when the connector 161 is engaged with the base 110 a fastener (for example a screw or a bolt) can be used to lock connector 162 in position, thereby locking the extension arm 160 into its position on lighting fixture 100. The extension arm 160 optionally includes knockouts 190 to provide locations where additional accessories 185, such as photo sensors, motion detectors and electronic controllers that affect the operation of the lighting elements (lamps), can be connected to the lighting fixture 100 via the extension arm 160.

Figure 13:
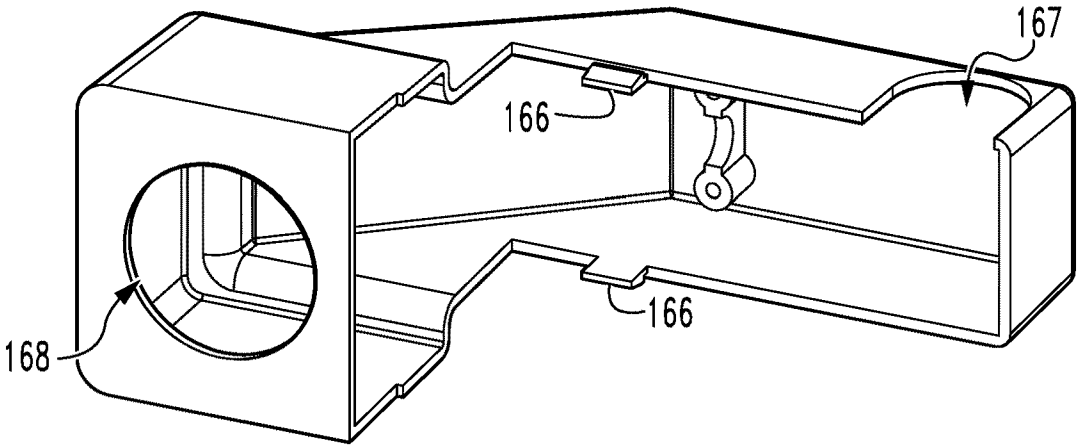
FIG. 13 is a lower perspective view of the accessory extension arm depicted in FIG. 12.
Figure 12:
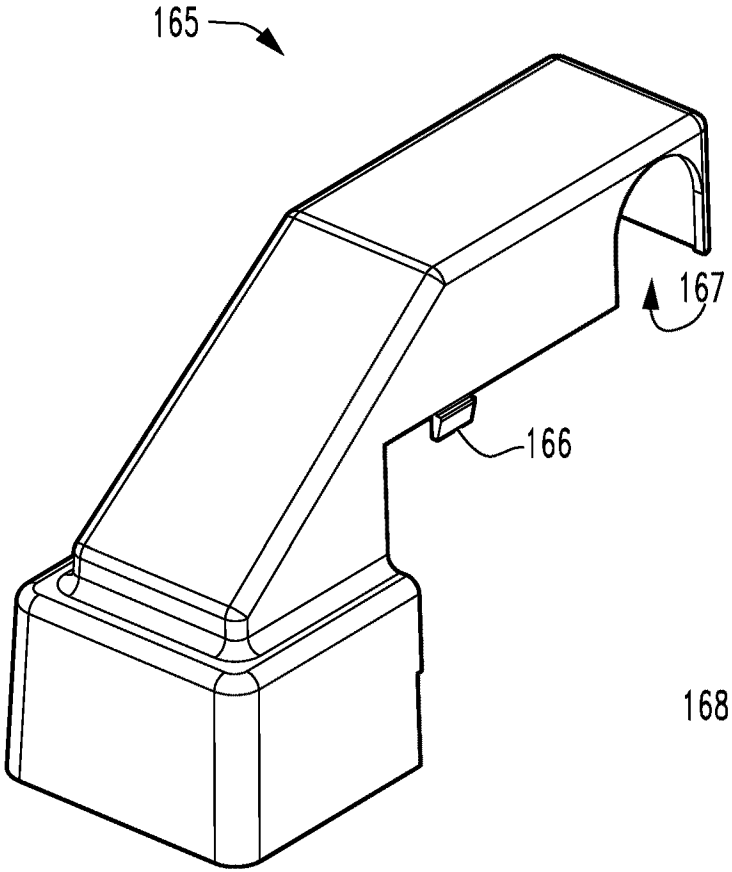
FIG. 12 is an upper perspective view of an accessory extension arm according to another embodiment of the present disclosure.

An extension arm accessory 165 according to another embodiment of the present invention is depicted in FIGS. 12, 13 and 17. Extension arm accessory 165 includes connectors 166 for attaching the extension arm accessory 165 to the lighting fixture 100. For ease of installation the connectors 166 are configured as tabs with tapered ends that fit into slots in the base 110. Due to their tapered ends the connectors 166 flex as they are inserted into the slots in base 110. Once the connectors 166 are fully inserted they snap into position and retain extension arm 165 on base 110. The extension arm 165 optionally includes knockouts 190 to provide locations where accessories 185, such as photo sensors, motion detectors and controllers, can be connected to the lighting fixture 100 via the extension arm accessory 165. In the embodiment depicted in FIG. 13, the knockout has been removed leaving aperture 168. The extension arm 165 may also include optional apertures to provide one or more passageways (for example passageway 167) between the extension arm 165 and other portions of lighting fixture 100, such as the movable member 120 and the electronic circuitry (for example, one or more LED drivers) contained therein.

Figure 14:
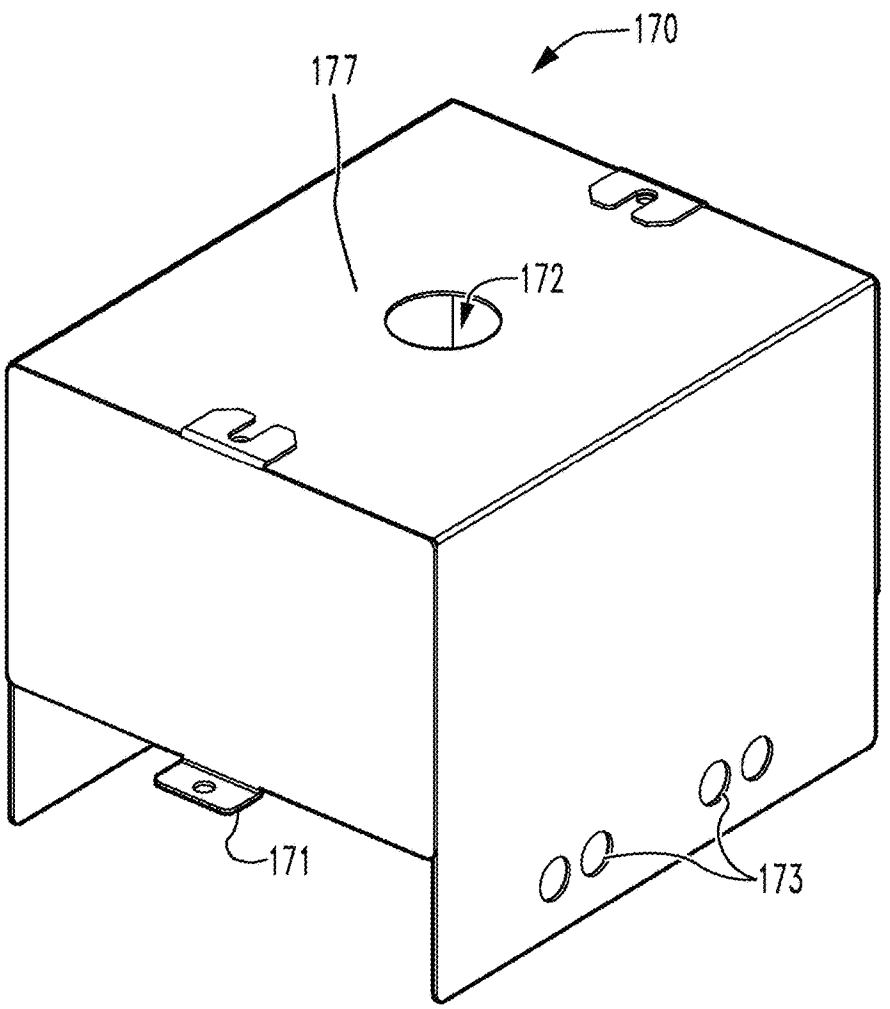
FIG. 14 is an upper perspective view of an accessory central extension box according to one embodiment of the present disclosure.
Figure 15:
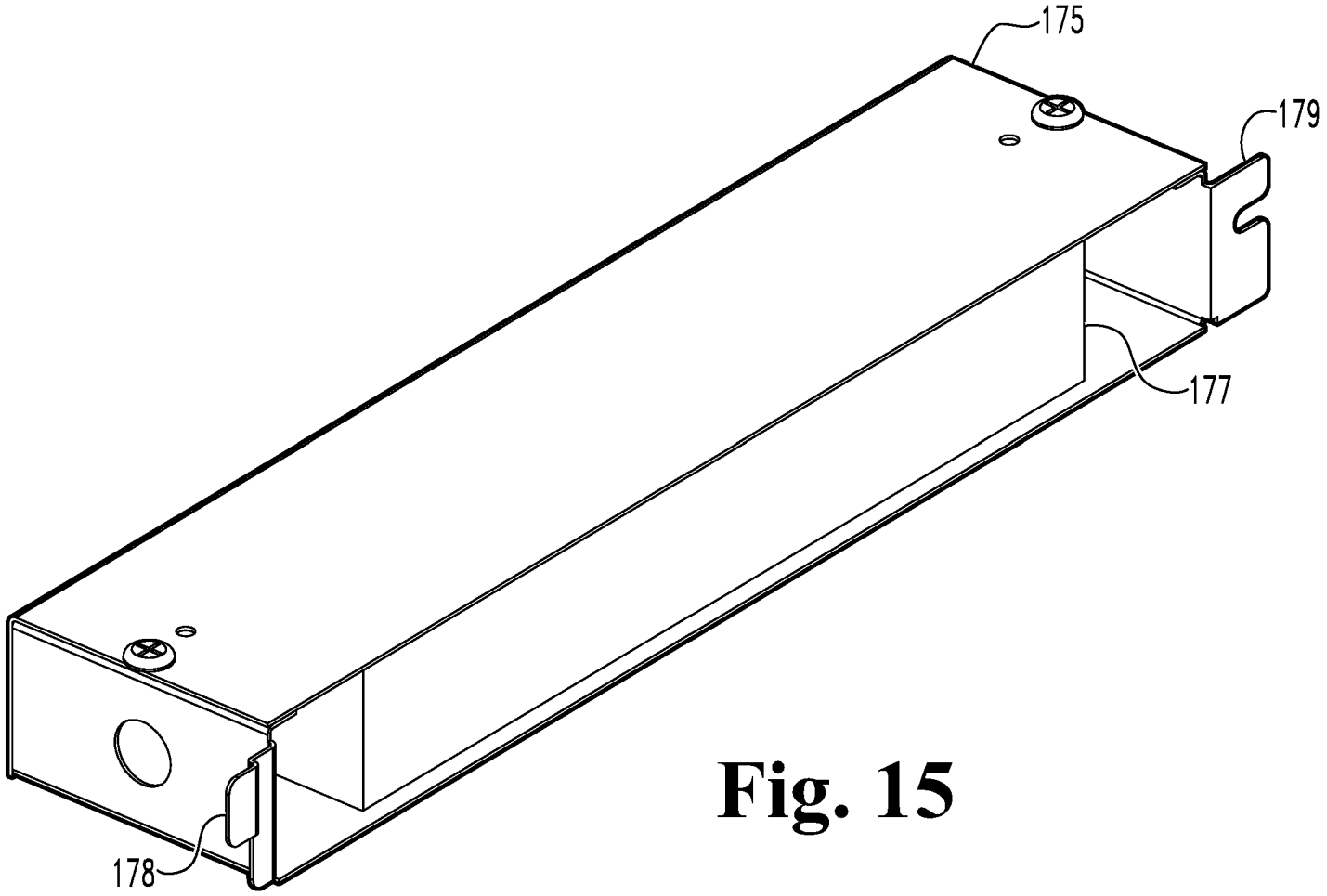
FIG. 15 is an upper perspective view of an auxiliary housing and an emergency battery according to one embodiment of the present disclosure.

An extender 170 according to one embodiment of the present invention is depicted in FIGS. 14, 15 and 17. The extender 170 includes connectors 171 for attaching the extender 170 to the lighting fixture 100. Although connectors 171 are depicted as tabs with apertures that allow use of a screw or other connector to hold the extender 170 to the lighting fixture 100, other forms of connectors such as the ones described herein (for example, connectors 161, 162 or 166) may be utilized. The extender 170 extends the mounted location of the lighting fixture 100 to a position farther below the ceiling that would be utilized if the center extender were not used, which may have advantages in rooms with higher ceilings. The extender 170 optionally includes knockouts 190 to provide apertures through which wiring can placed and to provide locations where accessories 185, such as photo sensors, motion detectors and electronic controllers, can be connected to the lighting fixture 100. In the embodiment depicted in FIG. 14, aperture 172 is included through which the electrical wires that power the lighting fixture 100 are placed. The aperture 172 may be formed by removing a knockout 190 or may be formed during construction of the extender 170. Extender 170 also includes optional apertures 173 for securing extender 170 to movable member 120. As shown in FIG. 17, the number and location of apertures 173 can allow extender 170 to be connected to differently sized movable members 120, where the different movable members 120 have mounting locations for receiving fasteners 174 in different locations or orientations.

Figure 16:
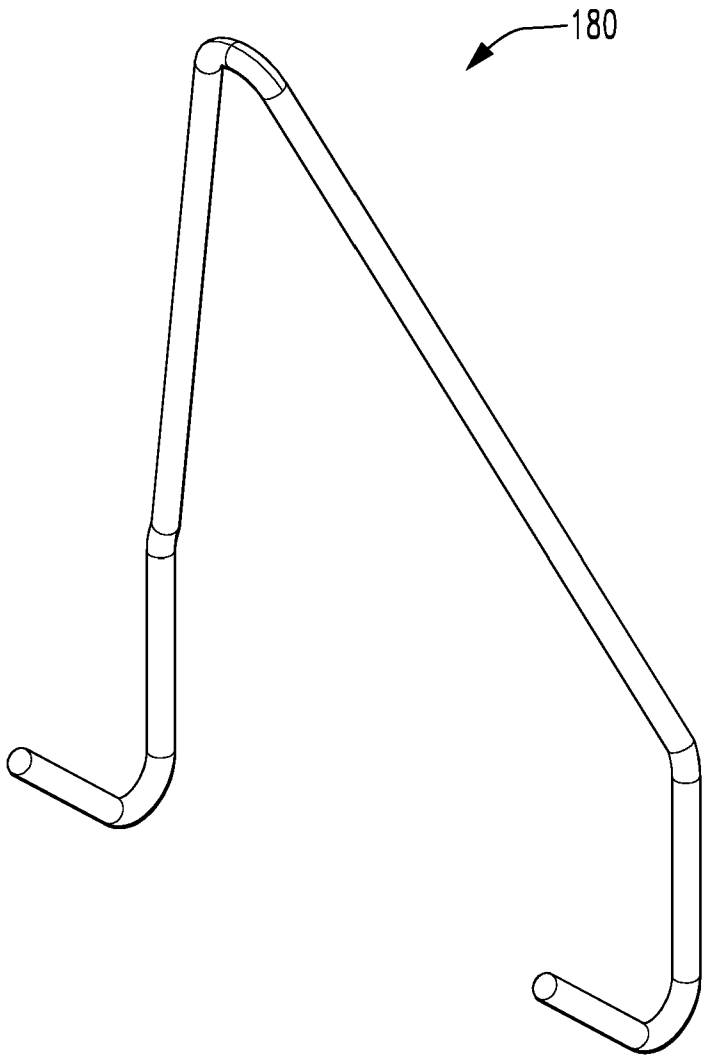
FIG. 16 is a perspective view of a hanger according to one embodiment of the present disclosure.

Hanger 180, depicted in FIGS. 16 and 17, can help balance the lighting fixture 100 when being positioned below the ceiling. In some embodiments, hangers 180 can be used in conjunction with the extender 170.

Depicted in FIGS. 15 and 17 is an auxiliary housing 175 according to one embodiment of the present disclosure. The auxiliary housing 175 is connectable to the movable member 120 and, when connected, moves up and down with movable member 120 as movable member moves between its extended and retracted positions. The auxiliary housing 175 is sized to be received within one of the cavities 118. In the depicted embodiment, the auxiliary housing 175 is connected to the side of movable member 120 using connectors 178 and 179. Connector 178 is a bent tab that fits within a slot in the movable member 120. The bend in the tab of connector 178 is configured to hold the auxiliary housing 175 laterally (in the direction defined by an axis extending between the connectors 178 and 179) in position once connector 178 is inserted into the slot in the movable member 120. To insert connector 178 into the tab in the moving member 120, the auxiliary housing 175 is oriented perpendicularly to moving member 120 with the axis extending between the connectors 178 and 179 extending perpendicularly to the long axis of the movable member 120. Once connector 178 is inserted into the slot in the movable member 120, the auxiliary housing 175 is pivoted around the connector 178 to place connector 179 in contact with the movable member 120, where a fastener can be inserted through the notch in connector 179 and a corresponding aperture in the movable member 120 to secure the auxiliary housing 175 to the movable member 120. The auxiliary housing may be used to house an emergency battery 177 capable of providing power to the light emitting members (lamps) during a power outage.

The external dimensions of the lighting accessory connectors (for example, the extension arm 160, the extension arm 165, extender 170, auxiliary housing 175 and hanger 180) can be configured so they are contained within and do not exceed the dimensions of the one or more cavities 118. As such, one or more accessory connectors may be placed within a cavity 118 when lighting fixture 100 is packaged, allowing the lighting fixture 100 to be packaged with one or more accessory connectors without requiring different packaging and without requiring larger packaging. Some embodiments include lighting accessory connectors that are too large to fit within the cavities 118 and that may be shipped separately. The accessory connectors may be hollow as depicted in FIGS. 10-15 to provide sufficient strength for attaching an electronic lighting accessory 185, such as photo sensors, motion detectors and electronic controllers, to lighting fixture 100 while minimizing the weight of the accessory connectors. The cavities 118 may also be sized to receive one or more electronic lighting accessories in addition to the accessory connectors.

An optional protective member, for example, protective cage 140, is depicted in FIGS. 4-6 and 17. The protective cage 140 is useful for protecting the lens and light emitters in workspaces where there is a possibility of an object impacting the fixture. The protective cage 140 can be placed over the top of the light fixture 100 for storage and shipping, then attached on the bottom of light fixture 100 after removal from the storage container and prior to installation. In other embodiments the protective cage 140 is shipped separately from the fixture.

After construction, lighting fixture 100 will typically be placed in the collapsed configuration for storage or shipping. If not already in the collapsed configuration, a user will depress the actuators 138 of the two locking members 130 located on either side of the lighting fixture 100, which will result in the locking surfaces 136 of the two locking members 130 away from the two retaining surfaces 128 located on opposite sides of movable member 120. Once the locking surfaces 136 are disengaged from the retaining surfaces 128, movable member 120 can be moved into its retracted position, placing the lighting fixture 100 in its collapsed configuration. With the lighting fixture 100 in the collapsed configuration, the lighting fixture 100 can be placed into a much smaller container, such as a typical cardboard box (for example, a cardboard box in the shape of a rectangular prism), than would be required if the lighting fixture 100 were in its operational (expanded) configuration. Because of the smaller size of the container, a larger amount of lighting fixtures 100 can be stored in the same space, thereby reducing the cost of storing the lighting fixtures 100.

When an order is received for the lighting fixture 100, the lighting fixture 100 can be shipped in the same container used to store the lighting fixture 100. Since the overall dimensions of the container are smaller than would be required if the lighting fixture 100 was in the expanded configuration, the costs of shipping the lighting fixture 100 will be reduced.

When the end user receives the lighting fixture 100, the end user will remove the lighting fixture 100 from the container and will typically remove any accessories stored in the cavities 118 from the lighting fixture 100. To configure the lighting fixture 100 for operation, the user will grasp the movable member 120 and pull upward on the movable member 120. As the movable member moves upward, the abutting surfaces 137 of locking members 130 travel along tracks 122 without contacting tracks 122 (although in some embodiments abutting surfaces 137 will slide against tracks 122 as the movable member 120 is moved) until engaging actuating surfaces 125, which are adjacent to retaining surface 128 at the ends of tracks 122. When the abutting surfaces 137 engage the actuating surfaces 125, the abutting surfaces 137 ride along the actuating surfaces 125 of the movable member 120 causing the flexible portion 135 of the locking member 130 to flex away from its resting position. As the movement of the movable member 120 continues, the abutting surfaces 137 move past the retaining surface 128 of movable member 120 and the flexible portion 135 automatically snaps into a position where locking surface 136 engages the retaining surface 128 of movable member 120 locking the movable member 120 in its extended position without requiring the user to separately engage the locking member 130.

While the movable member 120 is extended upward, the lamp mount 124 (which will frequently have a reflective surface for helping direct the light emitted from the light emitters downward and is connected to the movable housing 120 by connectors 126) moves upward and moves the light emitters away from the lens 112 (which is connected to the base 110). When the movable member 120 reaches it fully extended position, the distance between lens 112 and lamp mount 124 will have increased to the distance designed for lighting fixture 100 to emit the proper lighting pattern, which may be a diffuse lighting pattern where an observer looking directly at the lens will see few hot spots.

If an auxiliary housing 175 is included with the lighting fixture 100, such as to include a battery backup 177 that can power the lighting fixture 100 in the event of a building power failure, the auxiliary housing 175 will move out of the cavity 118 as movable member 120 is moved from its retracted position to its extended position.

With the lighting fixture 100 in the expanded configuration, the end user can attach accessories 185 (for example, motion detectors, photo sensors, and wireless controllers) the end user desires to use in conjunction with the lighting fixture 100. For example, the end user can attach extension arm 160 to the lighting fixture by inserting connector 161 into a slot on base 110, using a screw or similar fastening device to attach connector 162 to base 110, attach a motion detector to one of the knockouts 190 on the end of extension arm 160, and operationally connect the motion detector to the lighting fixture 100. In the embodiment shown in FIG. 17, item 185 depicts an example motion detector, although the motion detector is depicted upside-down with the curved sensor aimed upward instead of in its typical orientation in which it is aimed downward. If desired, the end user can attach additional extension arms, such as extension arm 165, to attach additional accessories.

The end user may mount lighting fixture 100 by attaching the movable member 120, for example, the top surface 121 of the movable member 120 (see FIG. 2), to a ceiling, a down rod extending downwardly from a ceiling, or other mounting structure. The end user may also attach extender 170 to the movable member 120 and attach extender 170, for example, the top surface 177 of extender 170 (see FIG. 14), to a ceiling, a down rod extending downwardly from a ceiling, or other mounting structure. Hangers 180 may be attached to the movable member 120 to help maintain the desired (for example, horizontal) orientation of the lighting fixture 100, which may be especially useful when the final configuration of the lighting fixture 100 is heavier on one side, such as there being one or more accessories on one side of the lighting fixture 100.

Reference systems that may be used herein can refer generally to various directions (for example, upper, lower, forward and rearward), which are merely offered to assist the reader in understanding the various embodiments of the disclosure and are not to be interpreted as limiting. Other reference systems may be used to describe various embodiments, such as referring to the direction of projectile movement as it exits the firearm as being up, down, rearward or any other direction.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used or applied in combination with some or all of the features of other embodiments unless otherwise indicated. One or more exemplary embodiments have been shown and described, and all changes and modifications that come within the spirit of the disclosure are desired to be protected.

ELEMENT NUMBERING

Table 1 includes element numbers and at least one word used to describe the member and/or feature represented by the element number. The embodiments disclosed herein are not limited to these descriptions, other words may be used in the description or claims to describe a similar member and/or feature, and these element numbers can be described by other words that would be understood by a person of ordinary skill reading and reviewing this disclosure in its entirety.

TABLE 1

| Element No. | Example Description |
|---|---|
| 100 | lighting fixture |
| 110 | base |

TABLE 1-continued

| Element No. | Example Description |
|---|---|
| 112 | lens |
| 114 | guides |
| 116 | aperture |
| 117 | aperture |
| 118 | cavity |
| 120 | movable member |
| 121 | aperture |
| 122 | track |
| 123 | auxiliary locking member |
| 124 | lamp mount (reflector) |
| 125 | actuating surface |
| 126 | connector |
| 127 | flexible portion |
| 128 | retaining surface |
| 129 | fixture electronics (for example, driver) |
| 130 | locking member |
| 131 | aperture |
| 132 | fastener |
| 133 | fastening portion |
| 134 | retaining member |
| 135 | flexible portion |
| 136 | locking surface |
| 137 | abutting surface |
| 138 | actuator |
| 140 | protective cage |
| 160 | extension arm (one embodiment) |
| 161 | connector |
| 162 | connector |
| 165 | extension arm (another embodiment) |
| 166 | connector |
| 167 | passageway |
| 168 | aperture |
| 170 | extender |
| 171 | connector |
| 172 | aperture |
| 173 | aperture |
| 174 | fastener |
| 175 | auxiliary housing |
| 177 | emergency battery |
| 178 | connector |
| 179 | connector |
| 180 | hanger |
| 185 | sensor |
| 190 | knockout |

What is claimed is:

1. An expandable lighting fixture for a room, comprising:

a lighting element;

a driver electrically connected to the lighting element;

an upper housing connected to the lighting element and the driver, the upper housing configured to attach to a building;

a lower housing; and a lens for protecting the lighting element mounted to the lower housing;

wherein the upper housing and the lower housing are movably connected to one another defining a collapsed configuration and an expanded configuration;

wherein the collapsed configuration is defined by one of the upper housing or the lower housing being received within a cavity of the other of the upper housing and the lower housing, and the lighting element and the lens being positioned a distance from one another; and wherein the expanded configuration is defined by the housing that is received within the cavity in the collapsed configuration extending out of the cavity, and the lighting element and the lens being positioned a greater distance from one another than in the collapsed configuration.

2. The expandable lighting fixture of claim 1, further comprising a slide mechanism, wherein the slide mechanism is configured to translate the upper housing relative to the lower housing such that the upper housing extends upward from the cavity.

3. The expandable lighting fixture of claim 1, further comprising a locking mechanism configured to automatically lock the upper housing in the expanded configuration.

4. The expandable lighting fixture of claim 3, further comprising an actuator coupled with the locking mechanism, wherein the actuator is configured to disengage the locking mechanism thereby allowing the upper housing and the lower housing to transition from the expanded configuration to the collapsed configuration.

5. The expandable lighting fixture of claim 1, wherein
the lens is connected to the lower housing,
the lighting element is attached to the upper housing, and
the lighting element moves the same distance as the upper housing when the upper housing moves in relation to the lower housing.

6. The expandable lighting fixture of claim 1, wherein the lower housing defines a cavity and is bounded by its outer dimensions, the upper housing is received within the cavity in the lower housing, and the upper housing is constrained within the outer dimensions of the lower housing when the upper housing and the lower housing are in the collapsed configuration.

7. The expandable lighting fixture of claim 6, wherein an upper surface of the upper housing is positioned flush with or below a top surface of the lower housing in the collapsed configuration.

8. The expandable lighting fixture of claim 1, wherein the collapsed configuration defines a collapsed height of the expandable lighting fixture, wherein the expanded configuration defines an expanded height of the expandable lighting fixture, wherein the collapsed height is approximately one-half (½) the expanded height.

9. The expandable lighting fixture of claim 1, further comprising at least one lighting accessory connector positioned in the cavity, wherein the at least one lighting accessory connector is configured to connect to the upper housing or the lower housing and provide an attachment location for at least one lighting accessory.

10. The expandable lighting fixture of claim 1, wherein the lower housing is rectangular and defines a length, wherein the upper housing is configured to form a central raised portion spanning the length of the lower housing.

11. An expandable lighting fixture, comprising:
a lighting element;
a driver electrically connected to the lighting element;
an upper housing connected to the lighting element and the driver, the upper housing defining a top surface configured to be mounted to a ceiling surface;
a lens for protecting the lighting element; and
a lower housing connected to the lens and defining a cavity, the lower housing being movably connected to the upper housing,
wherein the upper housing is selectively positionable in relation to the lower housing between a retracted position defined by the upper housing being received within the cavity such that the top surface of the upper housing is flush with or below a top surface of the lower housing relative to the ceiling surface, and
an extended position defined by the top surface of the upper housing being extended above the top surface of the lower housing.

12. The expandable lighting fixture of claim 11, wherein in the retracted position an upper-facing driver surface relative to the ceiling surface is flush with or below the top surface of the lower housing.

13. The expandable lighting fixture of claim 11, wherein in the extended position the lighting element and the lens are positioned a greater distance from one another than in the retracted position.

14. The expandable lighting fixture of claim 11, further comprising a locking mechanism configured to automatically lock the upper housing in the extended position when the upper housing reaches the extended position.

15. The expandable lighting fixture of claim 14, further comprising an actuator operatively coupled with the locking mechanism, wherein the actuator is configured to disengage the locking mechanism thereby allowing the upper housing to move from the extended position toward the retracted position.

16. A lighting fixture, comprising:
an array of lighting elements configured to emit light;
a lens positioned adjacent the array of lighting elements;
an upper housing including a mounting surface, the mounting surface configured to secure to a planar surface; and
a lower housing coupled with the upper housing, the lower housing including
a top surface facing the upper housing, and
a cavity configured to receive the upper housing,
wherein the upper housing is selectively transitionable in relation to the lower housing between a retracted position defined by the upper housing being received within the cavity and the mounting surface of the upper housing being flush with or below the top surface of the lower housing, and an extended position defined by the mounting surface of the upper housing being extended above the top surface of the lower housing.

17. The lighting fixture of claim 16, wherein the upper housing includes a driver configured to power the array of lighting elements.

18. The lighting fixture of claim 16, wherein the lighting fixture defines a collapsed height with the upper housing in the retracted position and an expanded height with the upper housing in the extended position, wherein the collapsed height is approximately one-half (½) the expanded height.

19. The lighting fixture of claim 16, wherein the lower housing is rectangular and defines a length, the upper housing forming a central raised portion spanning the length of the lower housing.

20. The lighting fixture of claim 16, further comprising a locking mechanism configured to automatically lock the upper housing in the extended position when the upper housing reaches the extended position.

* * * * *